US005593090A

United States Patent [19]

Werner

[11] Patent Number: 5,593,090

[45] Date of Patent: Jan. 14, 1997

[54] SNOW GUN

[76] Inventor: Richard Werner, R.R. #4,, Uxbridge, Ontario, Canada, L9P 1R4

[21] Appl. No.: 362,998

[22] Filed: Dec. 28, 1994

[51] Int. Cl.[6] ..... F25C 3/04

[52] U.S. Cl. ..... 239/2.2; 239/14.2; 239/2; 239/560

[58] Field of Search ..... 239/135, 14.2, 239/2.2, 261, 251, 566

[56] References Cited

U.S. PATENT DOCUMENTS

| | | | |
|---|---|---|---|
| 1,299,380 | 4/1919 | Plumer | 239/261 X |
| 1,577,225 | 3/1926 | Granger | 239/261 |
| 2,988,287 | 6/1961 | Sherman | 239/261 X |
| 4,856,712 | 8/1989 | Lanzani | 239/251 X |
| 5,154,398 | 11/1992 | Ratnik | 239/14.2 |
| 5,360,163 | 11/1994 | Dupre | 239/276 X |
| 5,379,937 | 1/1995 | Rothe | 239/135 |
| 5,385,106 | 1/1995 | Langshaw | 239/135 X |

*Primary Examiner*—Kevin Weldon

[57] ABSTRACT

The present invention relates to snow guns and improvements thereto. The improved snow gun has a large boom which receives liquid under pressure and forces it through small nozzles. The structure does not require high pressure compressed gas or large fan guns, and thus, is much more cost effective to install and operate. In a preferred form, the boom responds to changes in wind direction, which otherwise could reduce the effectiveness of the system.

17 Claims, 2 Drawing Sheets

SNOW GUN

FIELD OF THE INVENTION

The present invention relates to snow guns of the type used at major ski resorts.

BACKGROUND OF THE INVENTION

Many ski resorts have extensive snowmaking capability such that the resort has more control over the ski conditions throughout the ski season. Snow guns have improved dramatically over the last 30 years and resorts are able to produce a large snow base as long as the climatic conditions are generally cold. Most snow guns require a temperature of at least −5° C. and preferably −7° C. Colder temperatures make the snowmaking process easier.

Snowmaking equipment uses a combination of a pressurized liquid, generally water with certain additives thereto, in combination with compressed air, both of which are exhausted through a nozzle at high speed to form vapour droplets which basically freeze when exposed to the atmosphere or are frozen at least prior to hitting the ground. In this way, artificial snow is produced. The systems work satisfactorily, but require substantial capital investment as well as significant operating costs.

The other major snowmaking system uses fans (fan guns) which blow the water as it leaves a nozzle to provide mixing and a fine dispersion. The fans replace the compressed air requirement but increase the operation cost as well as the capital cost to bury electrical lines.

The capital costs are large due to the extensive piping for both the compressed gas and high pressure liquid as well as the compressors and pumps required to achieve the necessary operating pressures. The pumps and compressors also require substantial energy input to achieve the operating conditions necessary for snowmaking.

The present invention discloses a structure which simplifies the snowmaking process, reduces the capital costs required for a system and provides a system which has reduced operating costs.

SUMMARY OF THE INVENTION

An arrangement for making snow, according to the present invention, comprises an elongate snow boom having a tube arrangement with a series of nozzles spaced therealong with the tube arrangement closed either end. The snowmaking boom has a liquid feed arrangement for supplying pressurized liquid to the boom. The liquid is forced under high pressure through nozzles in the snow boom such that the exhausted liquid forms a fine dispersion of liquid droplets. The boom is supported at a raised position and is allowed at least a limited rotational movement about a vertical axis. With this arrangement, the snow boom can rotate to adjust to different wind conditions.

According to a preferred aspect of the invention, the boom is attached to a mast member which forms an axis about which the boom rotates.

According to a further aspect of the invention, the mast is attached to the boom at a central point in the length of the boom and forms part of the liquid feed arrangement. The mast accommodates the flow of liquid through the mast and into the boom and the boom is generally horizontal.

According to yet a further aspect of the invention, the mast is attached to the boom and rotates with the boom.

According to yet a further aspect of the invention, the boom is configured to cause liquid in the boom to drain towards the mast when the liquid is not under pressure. This allows effective drainage of the boom to reduce freezing of the liquid within the boom.

According to yet a further aspect of the invention, the arrangement includes electrical heating of the nozzles should the nozzles become frozen or require thawing prior to operating the system. As can be appreciated, the nozzles are quite small and can become frozen with a very small amount of liquid.

According to yet a further aspect of the invention, the mast supports the boom at a raised position of about 20 feet above ground level. This provides a substantial time period in which the fine vapour droplets or liquid droplets pass through the air prior to hitting the ground and will ensure that they are frozen and thus make snow prior to hitting of the ground.

According to the present invention, a method of making snow comprises providing water and appropriate additives under pressure to a boom arrangement at a raised position of at least 6 feet above ground level. The liquid is forced under high pressure, through a series of nozzles spaced along the boom to form a fine dispersion of water and additive droplets from each nozzle. The nozzles are spaced such that the fine dispersions from the nozzles do not interfere with each other. The water and additive droplets pass through the air at temperature of about 5° C. or colder and freeze, thereby forming artificial snow during the time period the droplets pass between the nozzle and ground level.

According to yet a further aspect of the invention, the method includes supporting the boom in a manner to allow rotation thereof in response to changes in wind direction such that the boom is orientated across the wind direction. With this arrangement, the fine dispersion of water and additive droplets from each nozzle basically flow with the wind and do not interfere with one another. By flowing with the wind, the wind tends to draw the dispersions away from the nozzles, and thus improves the ability to make snow.

Preferably, the boom has at least six nozzles to provide a large coverage area.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 3:
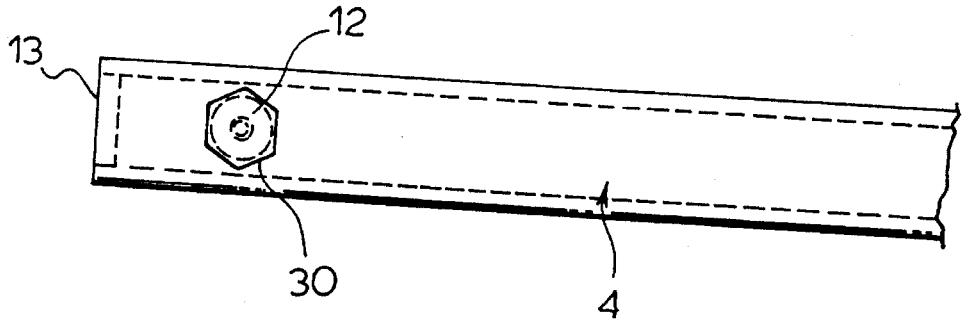
FIG. 3 shows the snow boom at one end thereof and the securement of a nozzle therein.

The snowmaking arrangement 2 comprises the snow boom 4 which is supported by the mast 6. The snow boom 4 includes a first arm 8 extending to one side of the mast and a second arm 10 extending to the other side of the mast. Each of the first and second arms are angled slightly upwardly to cause each arm to drain towards the mast. Each of the arms 8 and 10 are of a hollow pipe section which is closed at the end, as shown in FIG. 3. At appropriate positions along the length of the snow boom, nozzles 12 are provided which are designed to form a fine dispersion of water droplets when water is forced under high pressure through the nozzles. Typical pressure of the water is anywhere from 250 to 500 psi. Certain additives are normally incorporated in the water to improve the snowmaking ability. One such additive is called SNOMAX ® (Genencor International Inc.), a bacterial protein preparation used to induce the formation of snow and ice crystals in snowmaking. The mixture is preferably cooled to about 2° C. as is known for previous snowmaking systems.

Figure 1:
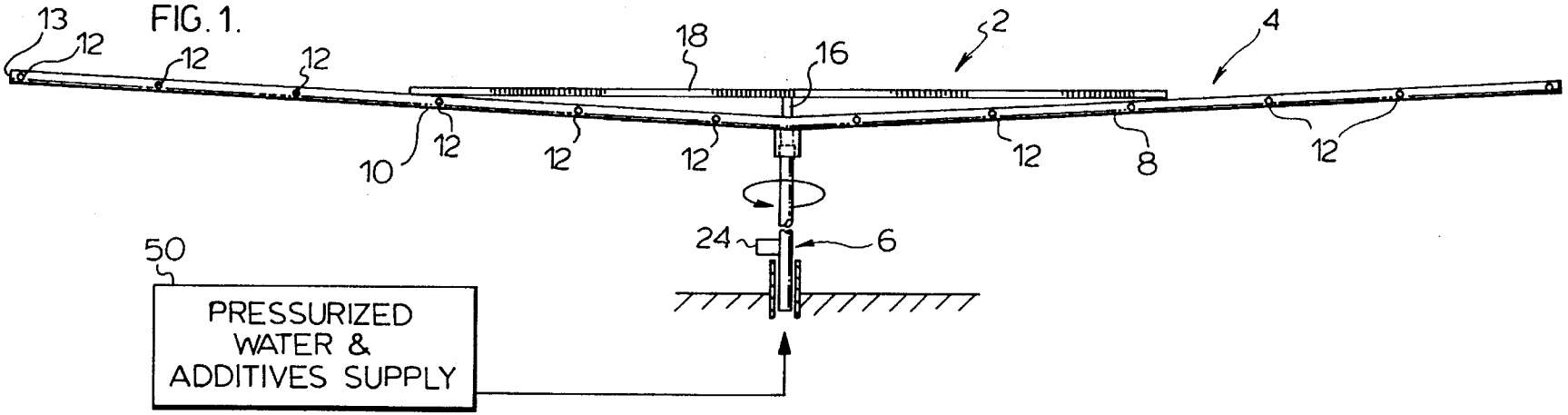
FIG. 1 shows a schematic of the snowmaking arrangement.
Figure 2:
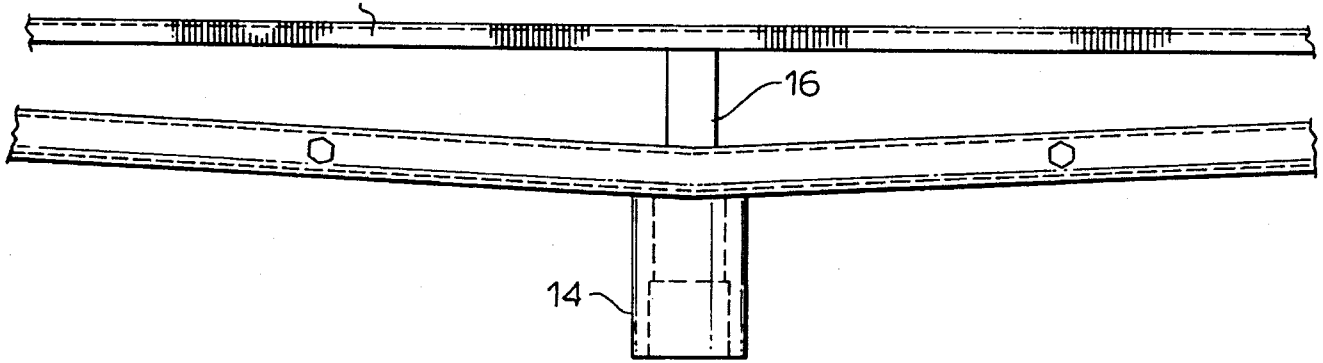
FIG. 2 shows a partial side view of the snow boom.

The nozzles 12 are preferably at least 18 inches apart and a spacing of approximately 22 inches has proven most satisfactory. Sufficient spacing is provided between nozzles such that the fine dispersion created by forcing the water through the nozzle do not interfere with each other to an extent to reduced the effectiveness of making snow. The fine dispersions basically interact with the air and freeze prior to reaching ground level. If the nozzles are too close, there will be a crossover of the dispersions and there will be a very high concentration at the overlap, which can affect the snowmaking capability. A spacing of 18 inches and the preferred 22 inches ensures that the dispersions of each nozzle do not inappropriately affect each other. Each of the arms 8 and 10 are preferably of an aluminum, such as a 1½ inch nominal diameter aluminum pipe. They can be closed at the end by a welded cap 13. The boom's overall length is approximately 20 feet and there are 12 nozzles placed on the boom. All of the 12 nozzles shown in FIG. 1 are on the same side of the boom. In order to provide additional support for each of the arms 8 and 10, the mast 6 includes an extension 16 which is connected to the cross connection 18, which is welded to each of the first and second arms 10. In this way, the arms 8 and 10 are angled slightly upwardly and any liquid in these arms will drain towards the mast 6. The mast 6 is connected to a high pressure water and additive supply 50 which supplies water and additives at a pressure of anywhere from 250 to 500 psi. It is preferable that the pressurized water be introduced into the boom through the mast 6. A separate hose can connect the base of the mast with the supply. In this way, when the snowmaking session is over, the mast 6 is disconnected from the supply and the boom and mast will drain quickly by gravity. In this way, the first arm, the second arm and the mast will drain, and thus will be in a condition suitable for start up of snowmaking at a later point.

Figure 4:
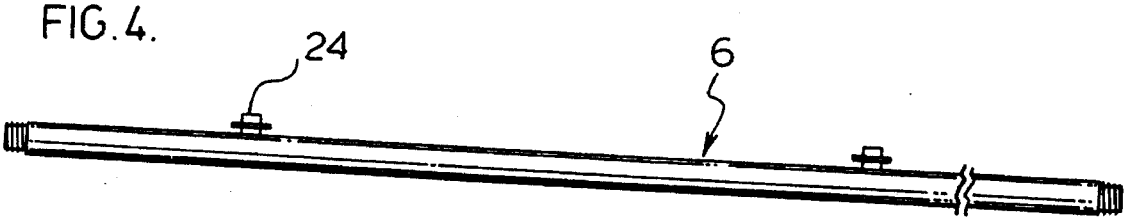
FIG. 4 illustrates the configuration of the mast.

The mast 6, as shown in FIG. 4, does include bushings 14 which can be supported within a column to allow rotation of the mast about the column. This is preferred as the large boom with the various vapour dispersions coming from the nozzle will orientate across the wind and thereby adjusts to the direction of the wind. This is important to keep the dispersions trailing away from the boom and to avoid interference with each other. It is important that the dispersions flow with the wind to carry them away from the boom, as, if they go into the wind, the droplets can be knocked down and will tend to merge and may not produce effective snow. Under low wind conditions this is often not a significant problem.

It is preferred that the boom be positioned at a raised position of at least 18 feet above ground level and preferably 20 to 30 feet above ground level. This provides a significant period of time from the initial expulsion of the water droplets from the nozzle to the time they reach ground level. This time will ensure that the vapour is frozen and effective snow is produced. The air temperature is typically −5° C. or colder and preferably −7° C. or colder.

Each of the nozzles is shown located within a coupling 30 which receives the threaded nozzles. The nozzles may be of the type sold by Snow Machine Inc. as SMI 078.

The exact height of the boom can vary with the particular circumstances. With the boom at six feet above the ground, the air air would have to be quite cold to produce effective snow. The quality of snow is dependent upon sufficient time for freezing of the fine dispersion while the dispersion is air borne. This time can vary with the water pressure and wind conditions as well as site conditions. The high boom height is a simple means to provide more than sufficient time for freezing, but under the right conditions, lower boom heights can also be effective.

Figure 5:
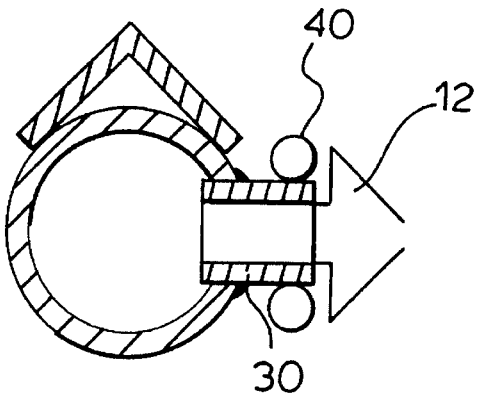
FIG. 5 shows details of one nozzle secured to the snow boom.

FIG. 5 shows a further embodiment of the invention wherein each of the nozzles include an electrical heating means, in this case cable 40, provided thereabout. It has been found that even with the effective drainage of the boom, the nozzles, due to the small port through which the liquid is forced, can freeze. The heating elements 40 are connected to a 12 volt portable power supply and initially heat the nozzles prior to operating the snow boom. In this way, the nozzles will be clear at start-up, regardless of the temperature and regardless of whether they froze after completion of the last snowmaking session.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An arrangement for making snow comprising an elongate snow boom having a tube arrangement with a series of nozzles spaced there along with said tube arrangement closed either end, said snow boom having a liquid feed arrangement for supplying pressurized liquid to said snow boom which liquid when exhausted through said nozzles forms a fine dispersion of liquid droplets, means for centrally supporting said boom generally horizontally at a raised position and to allow at least limited rotation about a vertical axis, and wherein said nozzles being orientated such that the fine dispersion of liquid droplets is generally from one side of said boom.

2. An arrangement as claimed in claim 1 wherein said boom is attached to a mast member which forms an axis about which said boom rotates in response to changes of wind direction to generally orientate said boom across the wind direction.

3. An arrangement as claimed in claim 2 wherein said mast is attached to said boom at a central point in the length of said boom and forms part of said liquid feed arrangement to said boom by accommodating the flow of liquid through said mast and into said boom.

4. An arrangement as claimed in claim 3 wherein said mast is fixed to said boom and rotates with said boom.

5. An arrangement as claimed in claim 3 wherein said boom is configured to cause liquid in said boom to drain towards said mast when the liquid is not under pressure.

6. An arrangement as claimed in claim 3 including an electrical heating for heating of said nozzles if said nozzles freeze closed.

7. An arrangement as claimed in claim 3 wherein said boom is about 20 feet in length.

8. An arrangement as claimed in claim 3 wherein said boom to either side of said mast includes at least 3 nozzles and each nozzle is spaced from an adjacent nozzle at least 18 inches.

9. An arrangement as claimed in claim 8 wherein said boom includes 6 nozzles either side of said mast.

10. An arrangement as claimed in claim 3 wherein said mast is of a length of about 20 feet.

11. A method of making snow comprising providing water and appropriate additives under pressure to a boom arrangement at a raised position of at least 6 feet above ground level, forcing the water and additives through a series of nozzles spaced along said boom to form fine dispersion of water and additive droplets from each nozzle without the requirement for introducing a pressurized gas to the water and additives prior to dispersion through said nozzles, passing said water and additive droplets through air at a temperature of –5° or colder to effect freezing of the fine dispersion, and thus, the formation of snow between said nozzles and the ground level.

12. A method as claimed in claim 11 including supporting said boom in a manner to rotate in response to changes in wind direction such that the boom is orientated across the wind direction.

13. A method as claimed in claim 12 wherein said boom is positioned at least 15 feet above ground level.

14. A method as claimed in claim 13 including supporting said boom at said raised position by using a vertical column member connected at a midpoint of said boom.

15. A method as claimed in claim 14 including supplying said boom with said pressurized water and additives through said mast which is in fluid communication with said boom.

16. A method as claimed in claim 15 including heating said nozzles prior to introducing pressurized water and additives to said boom to melt any ice in one of the nozzles which would block the nozzle.

17. A method as claimed in claim 16 wherein said mast includes a bearing arrangement which cooperates with a ground support member whereby said boom and mast rotate together in response to changes in wind conditions which otherwise would affect the ability to make snow.

* * * * *